US008256072B2

(12) United States Patent
Kolasa et al.

(10) Patent No.: US 8,256,072 B2
(45) Date of Patent: Sep. 4, 2012

(54) BUCKLE

(75) Inventors: Scott S. Kolasa, Mount Prospect, IL (US); John S. Pontaoe, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 809 days.

(21) Appl. No.: 11/946,589

(22) Filed: Nov. 28, 2007

(65) Prior Publication Data

US 2008/0134479 A1 Jun. 12, 2008

Related U.S. Application Data

(60) Provisional application No. 60/874,443, filed on Dec. 12, 2006.

(51) Int. Cl.
*A44B 11/25* (2006.01)

(52) U.S. Cl. ..... 24/625; 24/615; 24/614

(58) Field of Classification Search ..... 24/614, 24/615, 625, 629
See application file for complete search history.

(56) References Cited

U.S. PATENT DOCUMENTS

| | | | | |
|---|---|---|---|---|
| 5,222,279 | A | 6/1993 | Frano et al. | |
| 5,450,660 | A | 9/1995 | Frano | |
| 5,465,472 | A | 11/1995 | Matoba | |
| 7,140,082 | B2 * | 11/2006 | Chen | 24/625 |
| 2002/0040514 | A1 * | 4/2002 | Uehara et al. | 24/614 |
| 2004/0025310 | A1 | 2/2004 | Uehara et al. | |
| 2005/0076483 | A1 | 4/2005 | Chen | |
| 2007/0186394 | A1 * | 8/2007 | Hsiao | 24/614 |

OTHER PUBLICATIONS

International Search Report for PCT/US2007/086225.

* cited by examiner

*Primary Examiner* — Robert J Sandy
*Assistant Examiner* — Michael Lee
(74) *Attorney, Agent, or Firm* — Mark W. Croll; Paul F. Donovan

(57) ABSTRACT

A two-part buckle includes a male buckle component received in a female buckle component. Lock surfaces between the male and female buckle components are provided inwardly of flexible segments of the lock arms and axially between the flexible portion of the lock arm and accessible ends of the lock arms depressed for unlatching the buckle. The lock surfaces angle toward the disengaged positions in the direction of arm movement for unlatching.

4 Claims, 5 Drawing Sheets

BUCKLE

CROSS-REFERENCE TO RELATED APPLICATIONS

The present regular United States patent application claims the benefits of United States Provisional Application for patent Ser. No. 60/874,443, filed on Dec. 12, 2006.

FIELD OF THE INVENTION

The present invention relates to two-part buckles that include a male component snapped into a female component, with release effected by squeezing accessible portions of the male component, to disengage the male component from a locked condition in the female component.

BACKGROUND OF THE INVENTION

Two-piece buckles that snap together and latch automatically upon adequately inserting a male component into a female component are known and used in a variety of applications. A piece of webbing or strap can be attached to each of the components, and one or both buckle components can be adjustably retained on the strap or webbing. It is also known to have both components in fixed locations relative to a strap or web that is sewn or otherwise fixedly secured to the buckle component. Such buckles are known and used for a variety of applications, including outdoor recreational products like backpacks, bike helmets and life vests and other equipment. Two-part buckles are used also on luggage, bags, clothing and the like.

In one known design for buckles of this type, the female component defines a pocket and includes openings or windows on the lateral, opposed sides of the pocket. The male component includes arms having outward protrusions slightly wider than the width of the female component at some positions from the entrance to the window. As the male component is inserted into the female component, the arms are deflected inwardly and thereafter are allowed to rebound outwardly when the protrusions align with the windows in the female component. With the protrusion extending slightly outwardly at the window, the male component is secured within the female component. For added security, additional confronting surfaces on the male and female components engage one against another as the male component reaches a final, locked position. The strength of the buckle to resist unintended release when pulling force is applied against either component is determined by the nature of the engagement between the male and female component. The resistance to intended release, or stated another way, the difficulty in unlatching the buckle, is determined by the deflectability of the arms upon squeezing the protrusions inwardly from the window, and the resistance of the engaging surfaces to slide past or otherwise disengage from each other.

While buckles of the type described have had success in many applications, they are not without deficiencies, and improvements are sought after and advantageous. For example, to improve resistance to unintended release of the buckle when the buckle is placed under load; bulky, thick components have been used. Some buckles are difficult to release when under load. While such buckles may release easily when not under load, if the engaging surfaces are directed angularly forward, release requires movement of the male lock arms such that the male member is actually driven deeper into the female component as engaging surfaces slide beyond each other. When under load, this causes an increase in the load, and as a result, the release mechanism can be difficult to operate. Further, in manufacturing buckles of the type described, large tolerances are needed to overcome lock surface angles in the direction of latching. Accordingly, when latched but not under load, the male and female components may feel loosely fit one in the other and may even rattle or otherwise move one with respect to the other. While such looseness may not affect overall performance of the buckle, the user may feel that the buckle is not secure. The user may adjust the adjustable strap to make the strap exceedingly taut so that rattle is eliminated in that the buckle is under continuous load. This, then, can result in the aforementioned difficulty in releasing the buckle under load.

SUMMARY OF THE INVENTION

The present invention provides a two-piece buckle with a lock ledge interface located so as to transfer pulling force against the buckle to the lock arms in an outward direction, to thereby urge the arms toward the latching position rather than toward the unlatching position.

In one aspect thereof, the present invention provides a buckle with a female buckle component defining a pocket having a window and an entrance opening; and a male buckle component received in the pocket through the entrance opening. The male buckle component includes a lock arm in the pocket, the lock arm having a distal portion and a proximal portion relative to the entrance opening. The distal portion is accessible in the window, and the proximal portion is a flexible segment for bending of the arm. The female buckle component and the lock arm have cooperating interfacing surfaces securing relative positions of the components when the buckle is latched. The interfacing surfaces are inwardly of an axis defined by the proximal portion relative to the window. The cooperating interfacing surfaces are positioned in the buckle axially between the distal portion accessible in the window and the entrance opening.

In another aspect thereof, the present invention provides a buckle with a female buckle component defining a pocket having opposed sides and a window in each side; and a male buckle component received in the pocket. The male buckle component includes a web attachment structure and first and second lock arms extending from the web attachment structure. The first and second lock arms have distal portions accessible in the windows and proximal portions for flexing the arms. The female buckle component and the lock arms have cooperating confronting surfaces for securing the male buckle component in the female buckle component. The confronting surfaces are disposed inwardly of axes defined by the flexible proximal portions; and the cooperating lock surfaces angle toward the web attachment structure in the direction of movement for the arms unlocking the buckle.

In a still further aspect thereof, the present invention provides a two-part buckle with separable first and second parts. The first part has a bendable arm slidable into an end of the second part. The bendable arm has an inner end and an outer end relative to the second part, the inner end having a portion accessible along a side of the second part. The first and second parts have confronting lock surfaces for retaining the first part in the second part upon outward movement of the arm in the pocket. The confronting surfaces generate outward torque of the arm upon separating force applied against the parts. The buckle has an unlatching torque arm from the accessible portion of the bendable arm longer than a locking torque arm from the confronting surfaces for separating the first and second parts.

An advantage of the present invention, in one form thereof, is providing a two-piece buckle that latches and unlatches easily even when under load, but which resists unintended unlatching when load is applied to the buckle.

Another advantage of the present invention, in another form thereof, is providing a two-piece buckle that uses material efficiently in a buckle of improved strength.

Yet another advantage of the present invention, in yet another form thereof, is providing a buckle that fits together snuggly when latched, with minimal play between the buckle components even when not under load.

Other features and advantages of the invention will become apparent to those skilled in the art upon review of the following detailed description, claims and drawings in which like numerals are used to designate like features.

Figure 1:
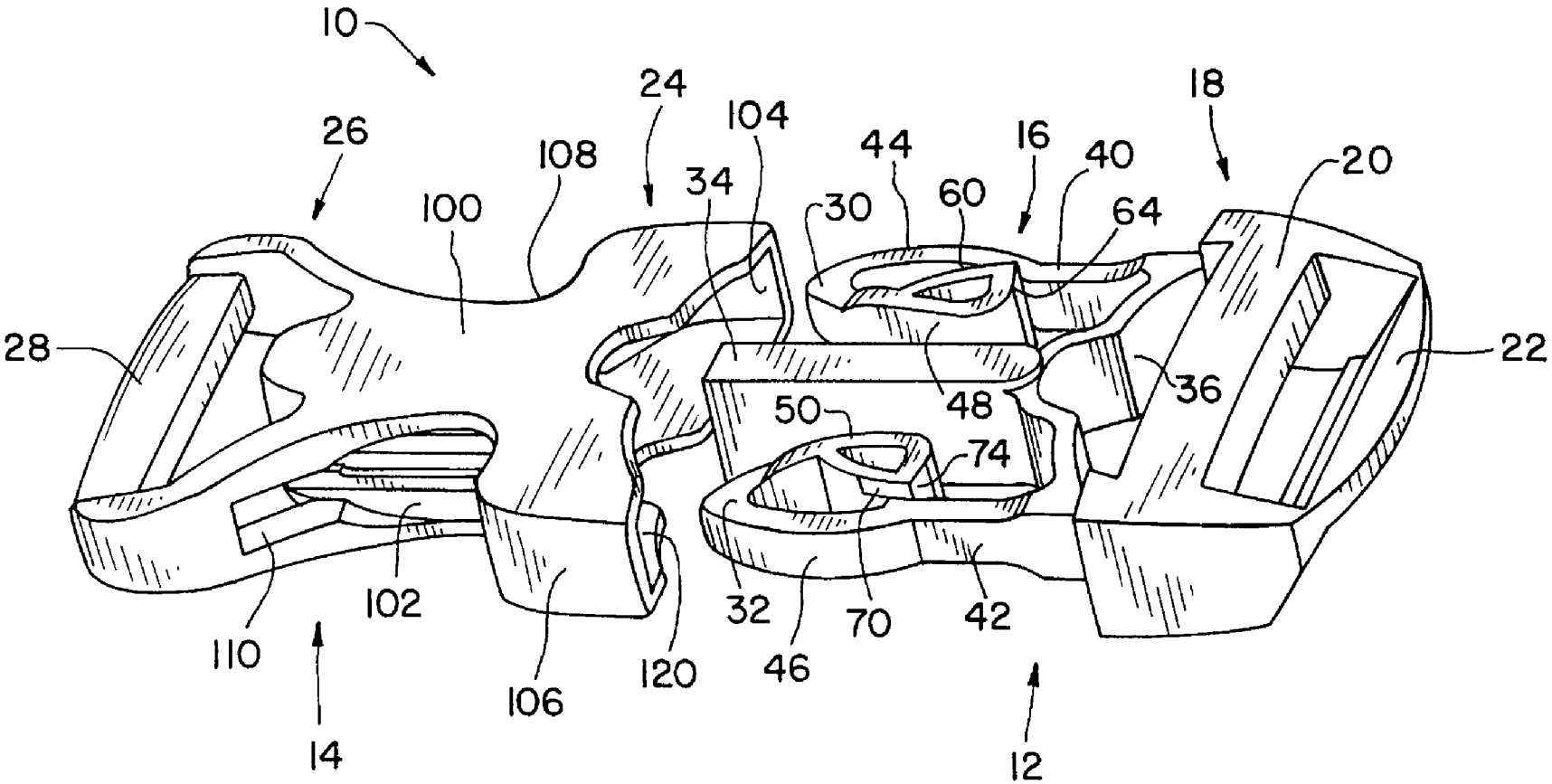
FIG. 1 is a perspective view of a buckle in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, a buckle 10 in accordance with the present invention is shown. Buckle 10 includes a male component 12 and a female component 14. Male component 12 includes a latch 16 and a web attachment structure 18 including web bars 20 and 22. Female component 14 includes a receiving body or pocket 24 and a web attachment structure 26 including a web bar 28. Latch 16 is inserted into and received by pocket 24 of female component 14 whereby buckle 10 is latched. Male component 12 and female component 14 can be made as individual monolithic structures of plastic formed by injection molding processes, or the like.

Straps or webs (not shown) can be attached to web bars 20, 22 and 28 in known manner so that buckle 10 can be used to secure together opposite ends of a single web or to secure ends of separate webs. In the exemplary embodiment shown in FIG. 1, web bars 20 and 22 of male component 12 can receive a web or strap laced there through in a serpentine pattern whereby the male component is securely positioned relative to the web or strap, but may be adjusted along the length of the strap, in known manner. The single web bar 28 on female component 14 can be used in a manner in which a strap or webbing encircles web bar 28, with the strap or webbing secured to itself by stitching, rivets or other types of fasteners so that female component 14 is permanently fixed in position relative to the strap engaged therewith. While the exemplary embodiment illustrates male component 12 that can be adjustably positioned along the length of a web, and female component 14 intended for permanent fixation relative to a web, it should be understood that either can be used as the other so that a female component can be used to adjustably position a web therein and the male component can be used whereby the web is permanently secured relative to it. Further, both can be provided with two web bars whereby either can be adjusted relative to the web secured thereto, and both can be provided with a single web bar whereby a web is fixed permanently relative to the buckle component. The manner in which a web is secured relative to male component 12 or female component 14 is not a limiting factor with respect to the application or use of the present invention.

Latch 16 of male component 12 includes first and second latch arms 30, 32 and an intermediate guide bar 34 projecting outwardly from attachment structure 18 of component 12. Guide bar 34 is positioned and between and spaced latch arms 30, 32. A spring-like arched brace 36 extends between proximal portions of arms 30, 32 and provides connection of guide bar 34 relative to each arm 30, 32 so that some relative deflection can occur between arms 30, 32 and guide bar 34.

Arms 30, 32 are mirroring structures that extend into female component 14 when buckle 10 is latched. Proximal ends of arms 30, 32 define thinner flex segments 40, 42 respectively, and distal ends of arms 30, 32 define bulbous portions 44, 46 respectively. Bulbous portions 44, 46 project laterally outwardly from axes defined by the non-deflected conditions of flex segments 40, 42, respectively. Upon lateral force exerted against bulbous portions 44, 46 arms 30, 32 deflect or bend along flex segments 40, 42, respectively, proximate attachment structure 18.

Figure 2:
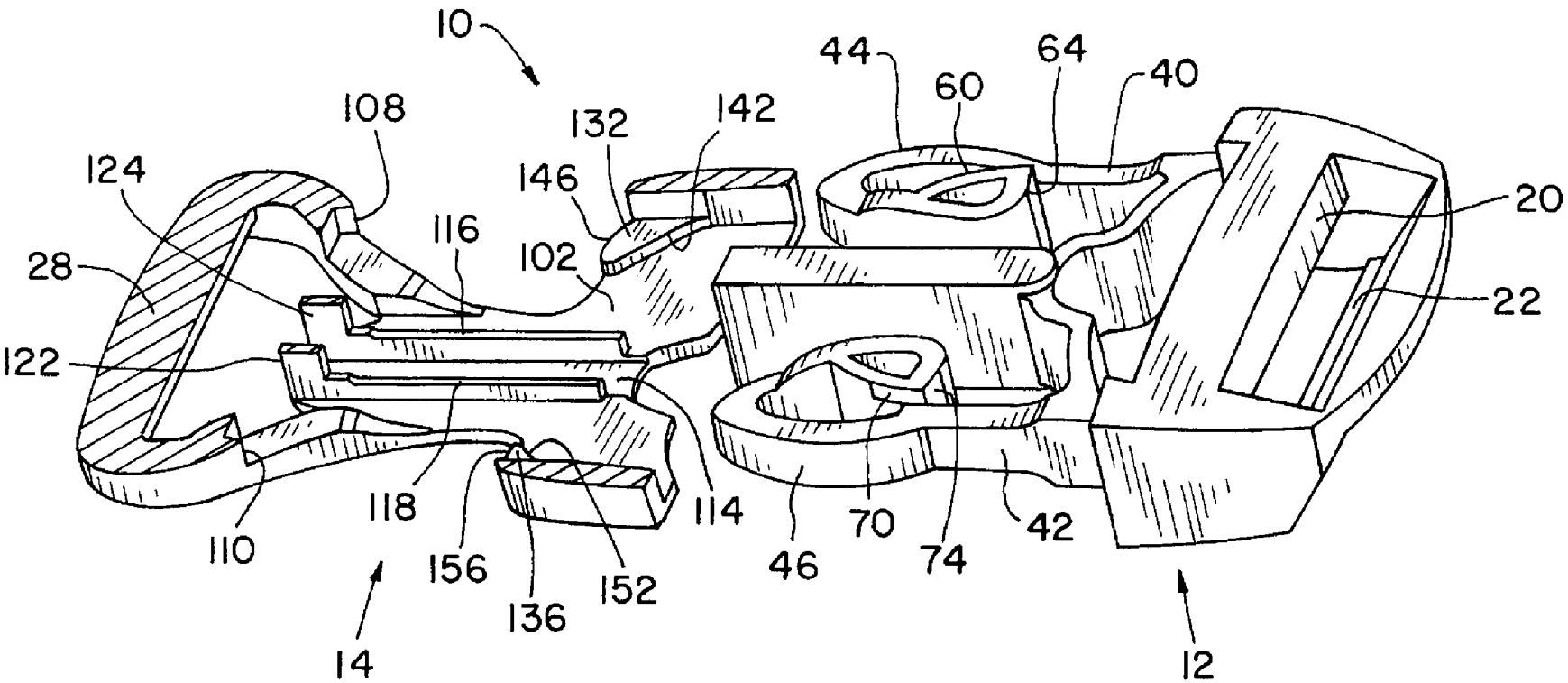
FIG. 2 is a partial cross-sectional view of the buckle shown in FIG. 1, with the female buckle component shown in cross-section.
Figure 3:
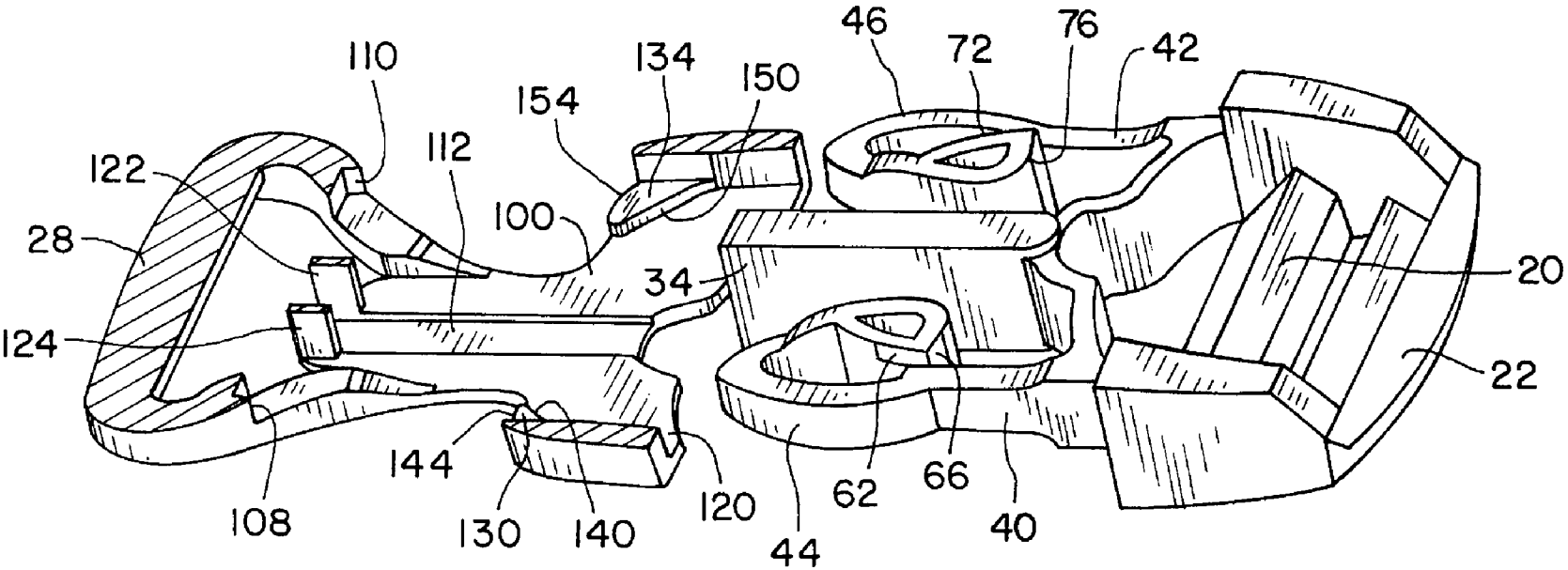
FIG. 3 is a partial cross-sectional view similar to FIG. 2, but showing the opposite side of the male buckle component and the other half of the female buckle component shown in cross-section.
Figure 4:
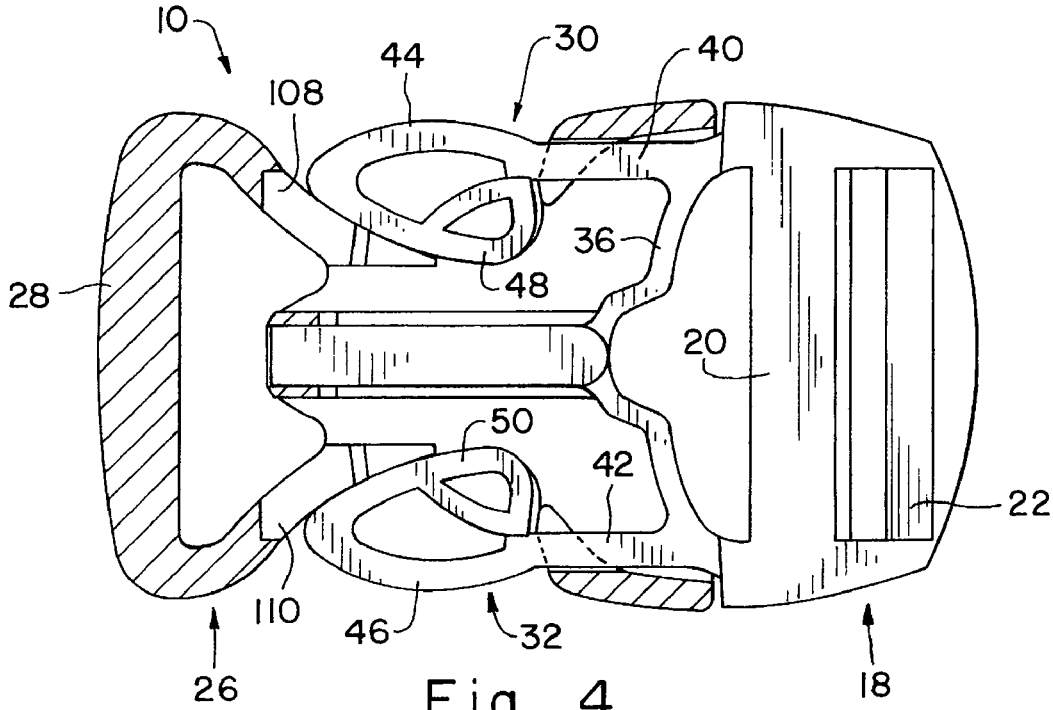
FIG. 4 is a partial cross-sectional view of the buckle shown in the previous views, but showing the buckle in a latched condition, with the female buckle component shown in cross-section.
Figure 5:
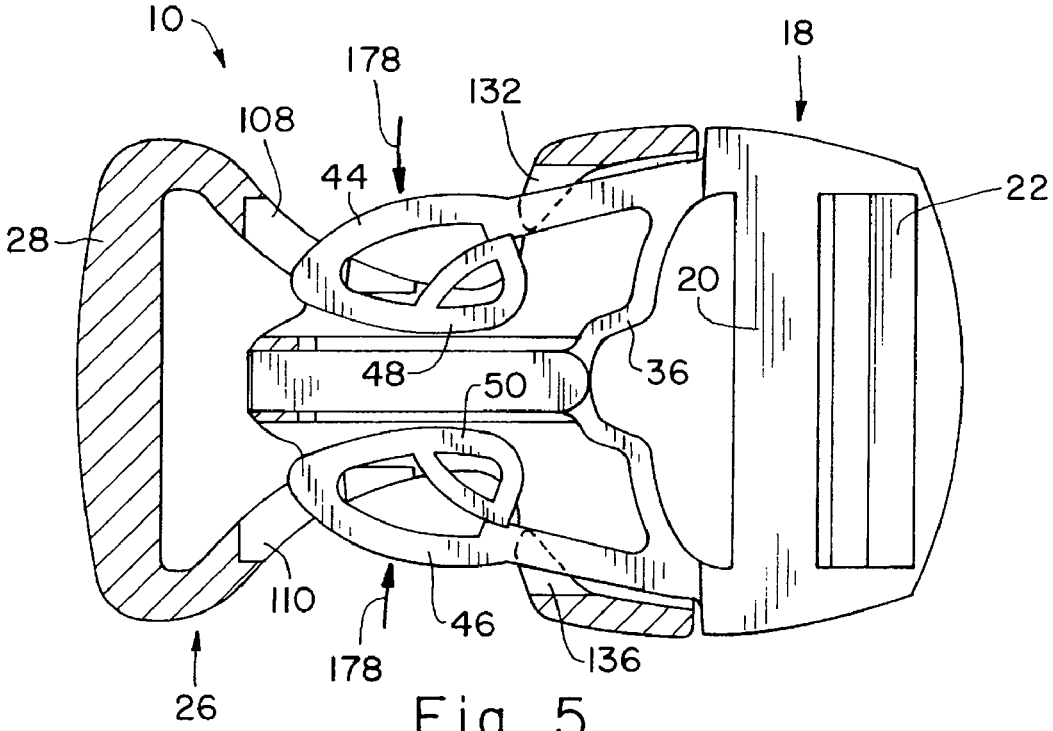
FIG. 5 is a partial cross-sectional view similar to that of FIG. 4 but illustrating the lock arms of the male buckle component in a released position so that the buckle can be separated.

Latching structures 48, 50 are provided inwardly of bulbous portions 46, and inwardly of the axes defined by non-deflected flex segments 40, 42. Latching structures 48, 50 are thicker than flex segments 40, 42 and bulbous portions 44, 46 and thereby extend above and below planes defined by upper and lower surfaces of flex segments 40, 42 and bulbous portions 44, 46, as can be seen from FIGS. 2 and 3 which show opposite sides of male component 12. Accordingly, latching structures 48, 50 each define two cam surfaces and two latch lock ledges adjacent the respective flex segment and bulbous portion associated therewith. Thus, latching structure 48 defines latch cam surfaces 60, 62 and latch lock ledges 64, 66 adjacent the upper and lower surfaces of flex segment 40 and bulbous portion 44 as shown in FIGS. 2 and 3. Similarly, latching structure 50 defines latch cam surfaces 70, 72 and latch lock ledges 74, 76 adjacent the upper and lower surfaces respectively of flex segment 42 and bulbous portion 46. It should be understood that terms such as "upper" and "lower" used herein with reference to surfaces of the various components are used with respect to the orientations as shown in the various drawings. Buckle 10 can be used in various orientations including horizontal, vertical on end and on side, and angularly positions therebetween. Buckle 10 need not be oriented with any particular surfaces up or down. The use of the aforedescribed terms in the descriptions and claims is merely to define the different surfaces as shown in the drawings, relative to one another, and are not intended to limit the manner or orientations in which buckle 10 can be used.

Cam surfaces 60, 62, 70, 72 are curved or angular surfaces extending progressively outward from more distal positions to more proximal portions thereof relative to attachment structure 18. Cam surfaces 60, 62, 70, 72 lead to lock ledges 64, 66, 74, 76 respectively at the proximal ends of cam surfaces 60, 62, 70, 72 relative to attachment structure 18. In an advantageous arrangement of the present invention, lock ledges 64, 66, 74, 76 are generally blunt surfaces, nearly but not exactly transverse to axes defined by flex segments 40, 42, as will be explained in more detail hereinafter.

Female component 14 is a pocket-like structure having plates 100, 102 on the top and bottom thereof, and sides 104, 106 between plates 100, 102. Sides 104, 106 define openings or windows 108, 110, respectively, which are elongated in configuration. Windows 108, 110 are sized and positioned to receive bulbous portions 44, 46 respectively when male component 12 is fully inserted into female component 14.

On inner surfaces thereof, top and bottom plates 100, 102 define channels 112, 114 respectively. Channel 114 is defined further by opposed walls 116, 118 extending from the surface of plate 102 in spaced relation to each other. Channels 112, 114 define a guide way for guide bar 34 to direct male component 12 straight into female component 14 from an entrance opening 120. While walls 116, 118 are shown only with respect to channel 114, it should be understood that channel 112 can be provided with similar walls or, if channels 112, 114 are sufficient depth to provide desired lateral support of guide bar 34, walls 116, 118 can be omitted. A pair of spaced supports 122, 124 is disposed at inner ends of channels 112, 114 relative to opening 120. Supports 122, 124 extend between plates 100, 102 for strength and rigidity and maintaining the shape of pocket 24.

Near the entrance ends of windows 108, 110; that is the ends of windows 108, 110 nearest entrance opening 120; the inner surfaces of top plate 100 and bottom plate 102 are provided with pediments 130, 132, 134 and 136. Accordingly, pediments 130, 132 are adjacent window 108, and pediments 134, 136 are provided adjacent window 110. Pediments 130, 132 define body cam surfaces 140, 142 and body lock ledges 144, 146, respectively, contiguous therewith. Pediments 134, 136 define body cam surfaces 150, 152 and body lock ledges 154, 156, respectively, contiguous therewith. Cam surfaces 140, 142, 150, 152 are curved or angular surfaces extending progressively inward from more distal positions to more proximal portions thereof relative to attachment structure 26 of female component 14. Cam surfaces 140, 142, 150, 152 lead to lock ledges 144, 146, 154, 156 respectively at the proximal ends of cam surfaces 140, 142, 150, 152 relative to attachment structure 26. In an advantageous arrangement of the present invention, lock ledges 144, 146, 154, 156 are generally blunt surfaces, nearly but not exactly transverse to axes defined by flex segments 40, 42, as will be explained in more detail hereinafter.

Latching structures 48, 50 cooperate with pediments 130, 132, 134, 136 during latching and unlatching of buckle 10, and to retain buckle 10 in a latched condition. More particularly, as latch 16 is inserted into receiving pocket 24 through entrance opening 120, latch arms 30, 32 pass along sides 104, 106, respectively. Guide bar 34 is received in channels 112, 114 and between walls 116, 118, to guide male component 12 into female component 14. Bulbous portion 44 slides between pediments 130, 132 and bulbous portion 46 slides between pediments 134, 136 as cam surfaces 60, 62, 70, 72 approach and encounter cam surfaces 140, 142, 150, 152; respectively. With continued inward insertion of arms 30, 32 into receiving pocket 24, cam surfaces 60, 62, 70, 72 slide along and against cam surfaces 140, 142, 150, 152, respectively. Bulbous portions 44, 46 and latching structures 48, 50 are deflected inwardly, whereby latch lock ledges 64, 66, 74, 76 slide past body lock ledges 144, 146, 154, 156 on the inside of the body lock ledges. As insertion is completed, latch lock ledges 64, 66, 74, 76 have moved only slight beyond body lock ledges 144, 146, 154, 156; cam surfaces 60, 62, 70, 72 disengage from cam surfaces 140, 142, 150, 152, whereby arms 30, 32 rebound outwardly. In moving outwardly, latch lock ledges 64, 66, 74, 76 are moved from inner to outer positions and into direct confrontation with body lock ledges 144, 146, 154, 156, respectively. Bulbous portions 44, 46 are accessible in windows 108, 110. In the outward positions of arms 30, 32; latch lock ledges 64, 66, 74, 76 directly confront and engage body lock ledges 144, 146, 154, 156; retaining latch 16 in pocket 24.

To unlatch or disengage buckle 10, bulbous portions 44, 46 are pressed inwardly at windows 108, 110, whereby arms 30, 32 are deflected inwardly by bending along flex segments 40, 42. Upon inward bending of arms 30, 32, latch lock ledges 64, 66, 74, 76 are moved inwardly, away from direct confrontation with body lock ledges 144, 146, 154, 156, respectively. Slight outward movement of latch 16 from pocket 24 positions latch cam surfaces 60, 62, 70, 72 into engagement with body cam surfaces 140, 142, 150, 152. Continued withdrawal of latch 16 from pocket 24 retains inward deflection of arms 30, 32 as latch cam surfaces 60, 62, 70, 72 slide along body cam surfaces 140, 142, 150, 152 until the cam surfaces clear one another. Withdrawal of latch 16 from pocket 24 is guided smoothly by opposite surfaces of bulbous portions 44, 46 sliding along spaced pediment pairs 130, 132, and 134, 136, respectively. Further, channels 112, 114 and spaced walls 116, 118 guide the withdrawal of guide bar 34 from pocket 24.

Figure 6:
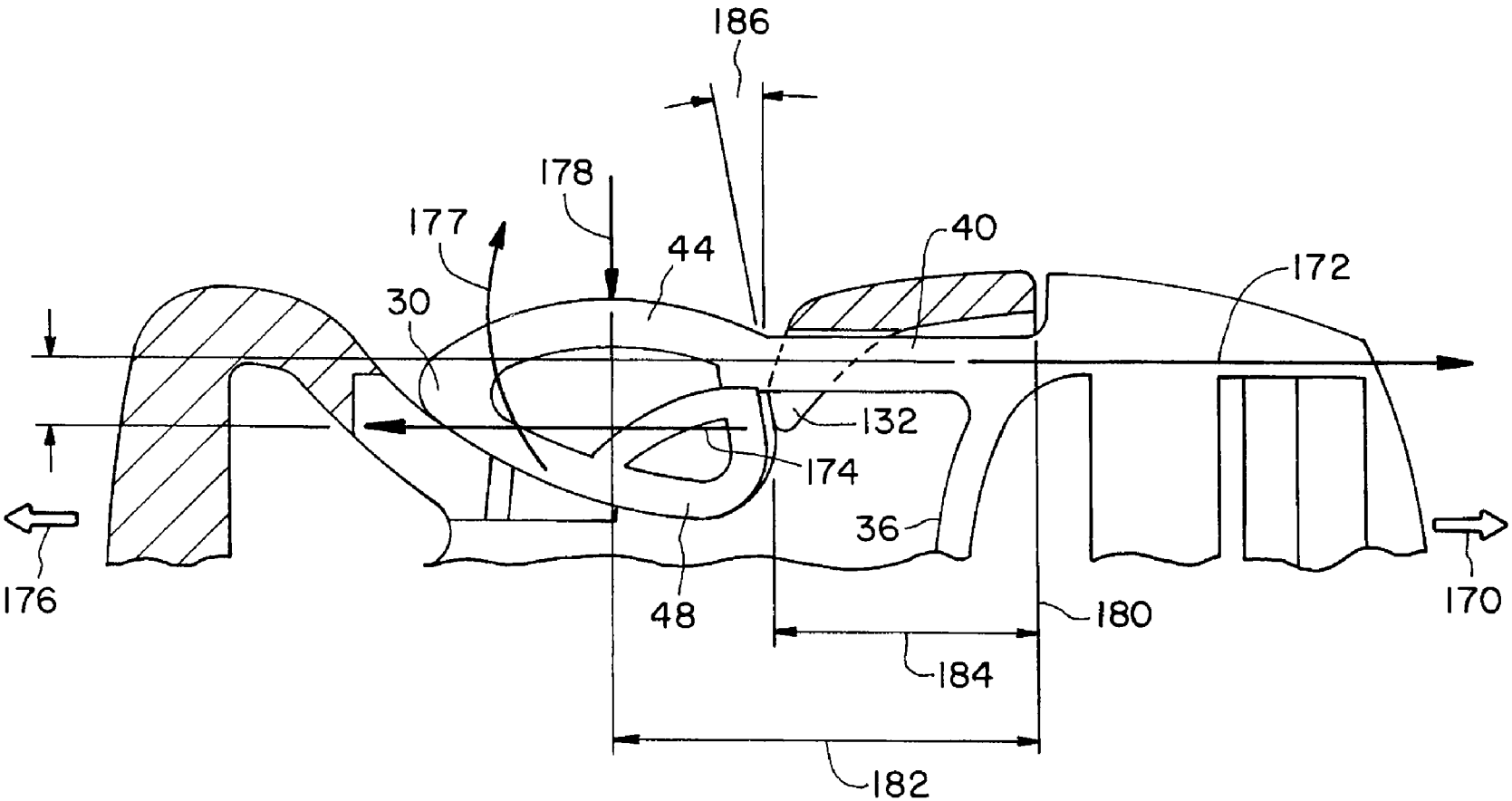
FIG. 6 is a partial cross-sectional view of the latched buckle shown in the preceding drawings, illustrating angular relationships of some of the parts of the buckle.

FIG. 6 illustrates angular and positional relationships for arm 30 and pocket 24, and more specifically latching structure 48 of arm 30 and pediment 132 of pocket 24. It should be understood that pediment 130 is vertically aligned with pediment 132, so that a similar relationship is defined with latching structure 48. It should be understood also that the relationship between arm 32 and pocket 24, and more specifically latching structure 50 with pediments 134, 136 is similar to that to be described with respect to FIG. 6.

Pulling force exerted on male buckle component 12, indicated by arrow 170, such as when buckle 10 is placed under load, is aligned along the axes of proximal end flex segments 40, 42 in male buckle component 12. Axis 172 for flex segment 40 of arm 30 is indicated in FIG. 6. The resistance to the pulling force is provided by the interfaces of latch lock ledges 64, 66, 74, 76 against body lock ledges 144, 146, 154, 156, respectively, and is transferred to female body component 14 in alignment with the interface, all inwardly of the axes of arms 30, 32. The force line for the resistance as transferred to female buckle component 14 through the interface of latching structure 48 with pediments 130, 132 is indicated by line 174 in FIG. 6. Similarly to that described above, pulling force exerted on female buckle component 14, indicated by arrow 176, is resisted at the interfaces of latch lock ledges 64, 66, 74, 76 against body lock ledges 144, 146, 154, 156, respectively, (line 174) and is transferred to male buckle component 12 along the axes of arms 30, 32; with axis 172 of arm 30 being shown.

The nonalignment of forces transferred between the buckle components 12, 14 results in torque, or twisting of distal end portions 44, 46, as indicated by arrow 177 in FIG. 6. Since the interfaces between components 12, 14 are inward of flex segments 40, 42 the twisting results in outward force of bulbous portions 44, 46 relative to windows 108, 110 when buckle 10 is placed under load by pulling force exerted against either component 12, 14. Release of buckle 10 requires inward movement of arms 30, 32 relative to windows 108, 110 such as by the application of inward force as indicated by arrow 178 for latch arm 30. Accordingly, the torque resulting from the nonalignment of forces when buckle 10 is under load, which causes outward movement of bulbous portions 44, 46, is generally opposite to the mechanism for release. Buckle 10 resists unintended release in that forces applied when buckle 10 is under load, which tend to pull components 12 and 14 in opposite directions, tend to move the distal ends of the arms in the direction for latching; thereby providing increased resistance to unintentional unlatching. With greater pulling force on either component 12 or component 14, greater torque is applied in the latching direction relative to bulbous portions 44, 46; and the latch remains secure.

The relative positions of the lock ledge interfaces with respect to the release force application areas in the present invention provide additional advantages when releasing the buckle under load. The interfaces of latch lock ledges 64, 66, 74, 76 against body lock ledges 144, 146, 154, 156, are positioned within buckle 10 axially between the area at which release force is applied, indicated by arrow 178 in FIG. 6 for latch arm 30, and the base of the flexure segments in the arms, indicated at line 180, which is substantially at entrance opening 120 when buckle 10 is latched. Accordingly, an unlatching torque arm length 182 for the force applied during unlatching of the buckle, from the application of release force at arrow 178 to the base of flexure at line 180 is longer than a locking torque arm length 184 created by resisting force, and defined between the base of flexure at line 180 and the point of load to be overcome at the interfaces of lock ledges 64, 66, 74, 76 with lock ledges 144, 146, 154, 156. Intended release is facilitated even when buckle 10 is under load in that unlatching torque arm 182 is longer than locking torque arm 184.

Latch lock ledges 64, 66, 74, 76 and body lock ledges 144, 146, 154, 156 are angular and not simply transverse to the buckle axis. With pulling forces against either component 12 or 14 inducing increased resistance to unlatch from the increased outward torque applied to bulbous portions 44, 46, as described above, the relationships of the interfaces between latch lock ledges 64, 66, 74, 76 and body lock ledges 144, 146, 154, 156 can be such as to facilitate unlatch when buckle 10 is under load. Thus, the angular relationship with respect to the movement of the surfaces past one another from the interface position to non-interface position upon release is in the direction of unlatch. In the direction of movement of arms 30, 32 during unlatch, the interfacing surfaces angle in the direction of withdrawal of latch 16 from pocket 24. Lock ledge interface angle 186 is illustrated in FIG. 6. Instead of unlatch requiring an increase in load, with the surfaces sliding one past another angling in the forward direction of latch insertion, so as to drive latch 16 more deeply into pocket 24, in the present invention unlatch causes an immediate withdrawal of latch 16 from pocket 24 as the interfacing surfaces of lock ledges 64, 66, 74, 76 against body lock ledges 144, 146, 154, 156 slide past one another angling in the rearward direction of withdrawal of latch 16 from pocket 24. The resistance to intended release of the buckle is determined primarily by the flexibility of flex segments 40, 42. The resistance from surfaces of lock ledges 64, 66, 74, 76 sliding along body lock ledges 144, 146, 154, 156 is minimized. The interface angle advantage combined with the lever length advantage obtained from the torque arm lengths discussed above, provide buckle 10 with improved ease of release when under load, compared to known buckles of the prior art.

Since the interfacing surfaces of latch lock ledges 64, 66, 74, 76 with body lock ledges 144, 146, 154, 156 travel along one another angularly in the direction in which latch 16 is inserted during latching and angularly in the direction of withdrawal during unlatch, a tighter fit between components 12 and 14 is facilitated. Buckle 10 latches and unlatches easily, and fits snuggly together when latched even if not under load.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A A buckle comprising:

a female buckle component defining a pocket having an entrance opening and first and second sides, each said side defining a window;

said female buckle component having pediments provided on opposed surfaces adjacent said windows at ends of said windows nearest said entrance opening, said pediments including pediment cam surfaces and blunt pediment lock ledges, said pediment lock ledges facing away from said entrance opening, and said pediment cam surfaces each being adjacent one of said pediment lock ledges between said pediment lock ledge and said entrance opening;

a male buckle component received in said pocket through said entrance opening;

said male buckle component including first and second lock arms in said pocket, each said lock arm having a distal portion and a proximal portion relative to said entrance opening, said distal portion including a bulbous portion positioned in said window when said buckle is latched, and said proximal portion being a more flexible segment of said arm along which said arm is bent to latch and unlatch said buckle, each said lock arm including a latching structure having a lock arm lock ledge facing toward said entrance opening with said lock arm in said pocket, and a lock arm cam surface adjacent said lock arm lock ledge and extending distally therefrom;

said pediments and said lock arm lock ledges engaged one against the other securing relative positions of said components when said buckle is latched, said engaged lock ledges being inwardly of an axis defined by said proximal portion relative to said window; and said lock ledges positioned in said buckle axially between said bulbous portions positioned in said windows and said entrance opening.

2. The buckle of claim 1, each said arm having a blunt lock arm lock ledge and a lock arm cam surface, and said lock ledges angling toward said entrance opening in the directions said arms are moved to unlatch said buckle.

3. A buckle comprising:

a female buckle component defining a pocket having an entrance opening and first and second sides, each said side defining a window;

said female buckle component having pediments disposed in said pocket on opposed surfaces and adjacent said windows at ends of said windows nearest said entrance opening, said pediments each having a pediment lock ledge facing away from said entrance opening and a pediment cam surface adjacent said pediment lock ledge between said pediment lock ledge and said entrance opening;

a male buckle component received in said pocket through said entrance opening;

said male buckle component including first and second lock arms in said pocket, each said lock arm having a distal portion and a proximal portion relative to said entrance opening, said distal portion defining a bulbous portion positioned to be accessible in one of said windows when said buckle is latched and said proximal portion having a flexible segment for bending of said arm to latch and unlatch said buckle, said first and second lock arms each including a latching structure having a lock arm lock ledge facing toward said entrance opening with said lock arm in said pocket, and a lock arm cam surface adjacent said lock arm lock ledge and extending distally therefrom;

said pediments and said lock arm lock ledges engaged one against the other securing relative positions of said components when said buckle is latched, said engaged lock ledges being inwardly of an axis defined by said proximal portion relative to said window; and said lock ledges positioned in said buckle axially between said distal portions accessible in said window and said entrance opening.

4. The buckle of claim 3, each said arm having a lock arm lock ledge and a lock arm cam surface, and said lock arm lock ledges angling toward said entrance opening in the directions said arms are moved to unlatch said buckle.

* * * * *